United States Patent [19]

Suzuki et al.

[11] Patent Number: 4,823,118

[45] Date of Patent: Apr. 18, 1989

[54] FIRE SENSOR

[75] Inventors: Takashi Suzuki; Akihiro Kobayashi, both of Tokyo, Japan

[73] Assignee: Nittan Company, Limited, Japan

[21] Appl. No.: 779,847

[22] Filed: Sep. 25, 1985

[30] Foreign Application Priority Data

Jan. 21, 1985 [JP] Japan ..... 60-5443[U]

[51] Int. Cl.[4] ..... G08B 23/00

[52] U.S. Cl. ..... 340/693; 200/11 R; 340/505; 340/825.54

[58] Field of Search ..... 340/693, 825.06–825.08, 340/505–506, 518, 584, 628, 541, 543, 539, 825.54, 535; 169/61, 23; 200/43.01, 11 R

[56] References Cited

U.S. PATENT DOCUMENTS 4,392,030 7/1983 Buss ..... 200/11 R
4,538,142 8/1985 Hamilton et al. ..... 340/667
4,555,695 11/1985 Machida et al. ..... 340/505 X
4,581,606 4/1986 Mallory ..... 340/505 X
4,616,223 10/1986 Naaijer ..... 340/825.54

*Primary Examiner*—Glen R. Swann, III
*Assistant Examiner*—Thomas J. Mullen, Jr.
*Attorney, Agent, or Firm*—Stevens, Davis, Miller & Mosher

[57] ABSTRACT

A fire sensor of the polling type in which plural fire sensors connected via a common line to a central monitoring point are called in sequence in accordance with individual addresses, wherein an address setting section in the fire sensors is improved. Address setting rotary digital code switches are installed on a printed circuit board on which the other components of the sensor are mounted, and holes for accessing the rotary code switches are formed in a body case in positions confronting the switches.

3 Claims, 1 Drawing Sheet

FIRE SENSOR

BACKGROUND OF THE INVENTION

The invention pertains a fire sensor in a polling type fire alarm system in which fire sensors connected to the same line are called in sequence by a fire signal receiver, and the fire sensors thus called transmit the results of their fire sensing operations to the fire signal receiver. More particularly, this aspect of the invention relates to the structure of an address setting section in such a fire sensor.

Recently, a fire alarm system has been proposed in which a microcomputer or the like is employed in a fire signal receiver, and a plurality of fire sensors having individual addresses are connected to a common line extending from the fire signal receiver, wherein the addresses of the fire sensors are sequentially called by the receiver to detect the results of their fire sensing operations. However, a specific method of setting addresses for the fire sensors has not previously been available.

In an example of a conventional address setting structure, an address setting switch is provided in the fire sensor. In assembling the fire sensor, its address is set by operating the switch. When it is required to change the address, the fire sensor must be disassembled, for instance, by removing the cover, etc. This operation is considerably troublesome, taking much time.

SUMMARY OF THE INVENTION

In a fire sensor according to the invention, address setting rotary digital code switches are installed on the printed circuit board on which the circuit elements are mounted, and holes for driving the rotary digital code switches are formed in the body case which confronts the rotary digital code switches.

In the fire sensor designed as described above, the address can easily be set or changed with a screwdriver or the like after the fire sensor has been assembled.

DESCRIPTION OF THE PREFERRED EMBODIMENTS

An example of a fire sensor according to a further embodiment of the invention will be described with reference to FIGS. 1A and 1B.

Figure 1A:
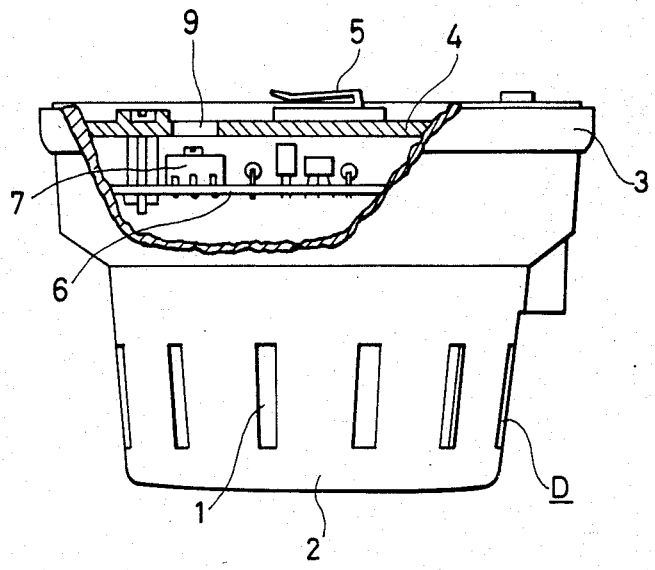
FIG. 1A is a front view of a fire sensor with parts cut away to show essential components thereof.
Figure 1B:
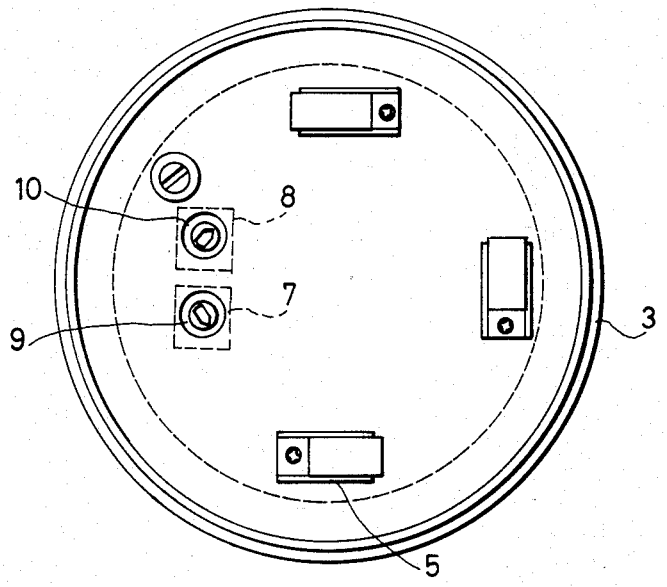
FIG. 1B is a bottom view of the fire sensor of FIG. 1A.

FIG. 1A is a sectional view showing essential components of a smoke sensor employed as a fire sensor, and FIG. 1B is a bottom view of the sensor.

As shown in FIGS. 1A and 1B, the external form of a fire sensor housing body D is defined by a base 3, and a cover 2. Reference numeral 1 designates holes through which smoke flows into the sensor; 4, a body rear case; 5, connecting board; 7 and 8, rotary digital code switches; and 9 and 10, holes formed in the body rear case 4 to allow access to the rotary digital code switches.

The number of rotary digital code switches (7 and 8) to be provided is determined according to the number of fire sensors D which are connected to one system. In this embodiment, two rotary digital codes switches employing the binary-coded hexadecimal system are used to set 256 addresses. As described above, the holes 9 and 10 are formed in the body rear case 4 located in front of the rotary digital code switches 7 and 8 so that the latter can be turned with a screwdriver inserted through the holes 9 and 10.

In assembling the fire sensor, the rotary digital codes switches 7 and 8 are mounted on the printed circuit board and secured by soldering in the same manner as other electrical circuit elements. After the addresses have been set, the holes 9 and 10 should be sealed so as to assist in avoiding the rotary digial code switches from being turned by unauthorized persons.

As is apparent from the above description, in the fire sensor according to the invention, the addresses can be readily set or changed externally with a screwdriver or the like. In addition, there is substantially no possibility that the switches can be turned by unauthorized persons. Moreover, the fire sensor of the invention is simple to manufacture and is low in cost.

We claim:

1. A fire sensor, comprising:

a housing;

a sensing means disposed in said housing for sensing a fire and transmitting a fire sensing indication signal to a fire signal receiver;

a printed circuit board provided in a bottom part of said housing;

address setting rotary digital codes switches installed on said printed circuit board to enable the fire signal receiver to address said sensor; and said housing including a case covering said printed circuit board and said switches; and said case including holes for providing access from the outside to said rotary digital codes switches, said holes being positioned adjacent said rotary digital codes switches.

2. The fire sensor as claimed in claim 1, wherein said address setting rotary digital codes switches operate in accordance with a binary-coded hexadecimal system.

3. The fire sensor as claimed in claim 1, further comprising means for sealing said holes to assist in avoiding access by unauthorized persons.

4. A polling type fire alarm system, comprising:

(a) a data transmission line, (b) a fire signal receiver connected to said line, (c) a plurality of individually addressable sensors connected in common to said line, for transmitting fire sensing indication signals to said fire signal receiver, said fire signal receiver sequentially calling said fire sensors to determine the status of said fire sensing indication signals; and (d) each of said fire sensors comprising (i) a housing, (ii) a printed circuit board disposed in said housing and a plurality of binary coded hexadecimal address setting rotary digital code switching means soldered on said printed circuit board, said housing including a case member covering said printed circuit board and said switches, said case member including a plurality of access holes for providing access from the outside by a mechanical tool to respective ones of said rotary digital code switching means, said plurality of access holes being positioned adjacent respective ones of said rotary digital code switching means, and (iii) a sealing means for sealing said access holes to assist in avoiding access by unauthorized persons.

* * * * *